United States Patent [19]

Prestwich

[11] 4,023,233

[45] May 17, 1977

[54] SURFACE CLEANING DEVICE

[75] Inventor: John Richard Prestwich, Berinsfield, England

[73] Assignee: Warwick Pump and Engineering Company Limited, Oxford, Great Britain

[22] Filed: Aug. 12, 1975

[21] Appl. No.: 603,996

[52] U.S. Cl. ..... 15/320; 15/353; 15/409

[51] Int. Cl.[2] ..... A47L 7/00

[58] Field of Search ..... 15/320, 321, 340, 345, 15/353, 409

[56] References Cited

UNITED STATES PATENTS

| | | | |
|---|---|---|---|
| 663,943 | 12/1900 | Thurman | 15/320 |
| 995,969 | 6/1911 | Junk | 15/409 X |
| 1,037,368 | 9/1912 | Symons | 15/409 X |
| 1,040,641 | 10/1912 | Coyle | 15/409 X |
| 1,211,902 | 1/1917 | Warner | 15/346 |
| 1,606,492 | 11/1926 | Ackerman | 15/409 X |

FOREIGN PATENTS OR APPLICATIONS

| | | | |
|---|---|---|---|
| 588,799 | 2/1959 | Italy | 15/340 |

*Primary Examiner*—Christopher K. Moore
*Attorney, Agent, or Firm*—Ladas, Parry, Von Gehr, Goldsmith & Deschamps

[57] ABSTRACT

A surface cleaning device comprising nozzle means for directing a high-pressure jet of liquid at an acute angle on to a surface, and collection means for collecting the liquid after deflection from the surface, said collection means including an inlet duct of approximately constant cross-sectional area having a lower wall terminating with an edge adapted in use to contact the surface ahead of the area of impingement of the jet, whereby in use the liquid jet deflected from the surface co-operates with the duct to create a jet-pump which sucks entrained air, stray liquid, and debris cleaned from the surface, into the duct.

10 Claims, 2 Drawing Figures

SURFACE CLEANING DEVICE

The present invention relates to a surface cleaning device having nozzle means for directing a jet of liquid under pressure onto the surface to be cleaned.

Some known forms of such a device have no means for collecting the spent liquid, which is usually water, after the liquid jet has contacted and cleaned the surface. Consequently liquid which rebounds from the surface is sprayed over a large area before eventually settling on the surface or flowing away into a drainage channel. Not only does this arrangement cause inconvenience for persons in the vicinity of the apparatus, but it also necessitates the waste of large quantities of liquid, since all liquid is lost after use.

To avoid such disadvantages, other known forms of surface cleaning device comprise a collection duct or trough which collects some spent liquid. However such ducts, which converge from a wide inlet to a throat, and known collection troughs, are inefficient in that some spent liquid is lost and remains on the surface being cleaned, while high-powered vacuum pumps are needed to remove the spent liquid together with air entrained therewith from the surface.

An object of the present invention is to provide surface cleaning apparatus having a more efficient fluid collection means.

According to the present invention, there is provided a surface cleaning device comprising nozzle means for directing a high-pressure jet of liquid at an acuate angle on to a surface, and collection means for collecting the liquid after deflection from the surface, said collection means including an inlet duct of approximately constant cross-sectional area having a lower wall terminating with an edge adapted in use to contact the surface ahead of the area of inpingement of the jet, whereby in use the liquid jet deflected from the surface co-operates with the duc to create a jet-pump which sucks entrained air, stray liquid, and debris cleaned from the surface, into the duct.

In contrast with known surface cleaning devices having collection means including an inlet duct which converges from a wide inlet, and which thereby require a powerful suction fan to draw air entrained with the liquid up the duct, the device of the present invention employs an inlet duct which is cross-section is of approximately constant area and preferably in the form of an elongate slot. Such a duct fulfils the requirements for the creation of a jet-pump in which the jet deflected from the surface and directed into the duct efficiently sucks in entrained air, together with stray liquid and debris cleaned from the surface.

The surface-contacting edge at the mouth of the duct is essential to the satisfactory working of the device, since otherwise part of the deflected liquid jet escapes under the edge and goes to waste.

The invention will now be more particularly described by way of example with reference to the accompanying drawings, in which.

Figure 1:
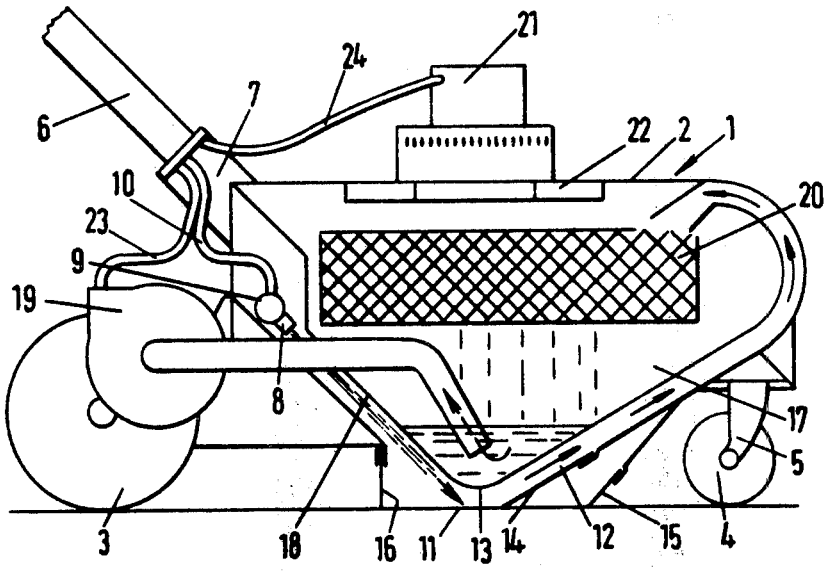
FIG. 1 is a diagramatic side view in cross-section of a surface cleaning device.

The surface cleaning device shown in FIG. 1 is pedestrian operated and comprises a main body 1 having a removable lid 2. The main body 1 is supported on rear wheels 3, which may be drive wheels, and front jockey wheels 4 on rotatable members 5 which permit the direction of movement of the device to be changed. The machine is guided by means of a handle 6 attached to a bridge member 7, which may be pivotally or rigidly connected to the main body 1.

A row of nozzles 8 is arranged on a tube 9 supplied with liquid at high pressure from a pipe 10 passing up the handle 6 to an external source. The nozzles 8 are each adapted to produce a substantially planar fanned jet, so that a continuous elongate jet of liquid hits the surface being cleaned at the area of impingement 11.

After deflection from the surface, the liquid passes into an inlet duct 12, whose cross-section is in the form of an elongate slot, and which remains approximately constant in cross-sectional area. The liquid deflected from the surface thereby co-operates with the duct 12 to create a jet-pump which draws air entrained by the liquid together with debris cleaned from the surface up into the duct 12. The duct has an upper wall 13, and a lower wall terminating in a resilient flap 14 which is in contact with the surface being cleaned. This surface contact is essential to the efficient working of the device, since otherwise a substantial quantity of liquid would escape under the flap 14. The surface between the point of inpingement 11 and the flap 14 thus effectively forms a mouth for the duct 12 in co-operation with the upper wall 13, which is shown curved in FIG. 1, but which may also be flat and parallel with the surface, and the mouth formed thereby maintains the approximately constant cross-sectional area of the duct 12.

Since a partial vacuum is produced by the jet-pump effect in the region of the mouth, there is a tendency for the flap 14 to lift up, and to resist this tendency an additional resilient flap 15 in contact with the surface ahead of the flap 14 is provided, the chamber formed between the two flaps communicating with the duct 12 through openings in the duct wall. A further surface-contacting flap 16 is provided behind the point of impingement 11, to contain stray liquid.

After passing up the duct 12, the liquid, and air and debris entrained therewith, passes into a sump 17 formed by a wall 18 situated above the path of the liquid jet. Liquid is withdrawn from the sump by means of a pump 19, such liquid being free of larger pieces of debris, which are collected in a perforated basket 20 above the sump 17, and of smaller pieces of debris and sediment which sink to the bottom of the sump 17. The removable lid 2 permits the basket 20 and sump 17 to be removed periodically and emptied of debris.

Mounted on the lid 2 is a suction pump 21 and vortex liquid separator 22 for withdrawing the air entrained by the liquid jet and drawn up the duct 12.

Power lines 23 and 24 for the pumps 19 and 21 respectively pass up the handle 6 to an external source. The combined power requirements of the suction pump 21 and water pump 19 is considerably less than that which would be required to withdraw fluid from the duct 12 up a pipe to an external air-liquid separator. Futhermore, by virtue of the jet-pump created by the liquid jet and the duct 12, the power of the suction pump 21 can itself be relatively low, and in certain circumstances the pump 21 can be dispensed with altogether.

Water withdrawn from the sump 17 by the pump 19 would, in the example illustrated, pass to an external filter and water recovery machine, but it is also possible to provide means on the device for filtering and re-circulating the water to again supply the nozzles 8. This is most advantageous in the case of a larger self-propelling device, which is equally within the scope of the present invention.

Figure 2:
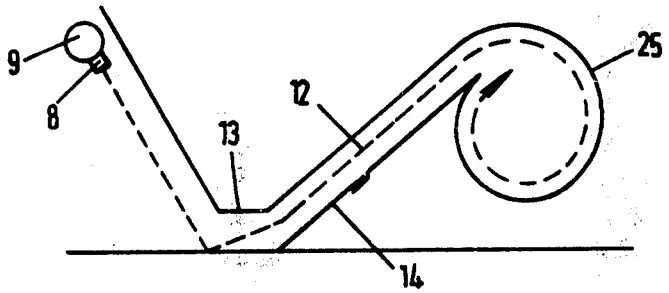
FIG. 2 is a diagramatic side view in cross-section of an alternative form of fluid collection means for the device.

An alternative form of fluid collection means is shown in FIG. 2. The arrangement of nozzles 8 on the tube 9 and the slot-like inlet duct 12 with surface contacting flap 14 is similar to that described above, but the duct 12 leads tangentially into a cylindrical fluid recovery chamber 25 extending parallel to the tube 9. The chamber 25 has a suction outlet either at one end or in the centre of the chamber, which either leads to an external suction and water-separating machine, or to a sump arrangement as described above with reference to FIG. 1. The nozzles 8 are disposed so that their axes do not lie in planes perpendicular to the axis of the chamber 25 but lie in planes which are inclined towards the outlet of the chamber, and thereby induce a helical flow of fluid in the chamber 25 towards the outlet, producing an efficient means of fluid collection.

FIG. 2 also shows how the upper wall 13 at the mouth of the duct 12 may also be made flat and parallel with the surface being cleaned.

I claim:

1. A surface cleaning device comprising nozzle means for directing a high-pressure jet of liquid at an acute angle on to a surface, and collection means for collecting the liquid after deflection from the surface, said collection means includingan inlet duct of approximately constant cross-sectional area having a lower wall terminating with an edge adapted in use to contact the surface ahead of the area of impingement of the jet, whereby in use the liquid jet deflected from the surface co-operates with the duct to create a jet-pump which sucks entrained air, stray liquid, and debris cleaned from the surface, into the duct.

2. A device as claimed in claim 1 wherein said nozzle means is formed such as to emit a substantially planar fanned jet, the inlet duct having in cross-section the form of an elongate slot.

3. A device as claimed in claim 2 wherein an upper wall of the inlet duct is adapted to co-operate in use with the surface to form a mouth for the duct maintaining the approximately constant cross-sectional area of the duct.

4. A device as claimed in claim 3 wherein the collection means includes a cylindrical liquid recovery chamber, extending parallel to said tube, for receiving liquid from the duct, said nozzles being inclined towards an outlet in said chamber to produce a helical flow of liquid towards said outlet.

5. A device as claimed in claim 1 wherein said nozzle means comprises a plurality of nozzles mounted on a tube which supplies high-pressure liquid to each nozzle.

6. A device as claimed in claim 1 further comprising a sump for receiving spent liquid from the duct, and means for extracting liquid from said sump.

7. A device as claimed in claim 6 wherein a perforated basket is removably disposed in the sump for collecting particles of debris from the liquid.

8. A device as claimed in claim 6 wherein comprising a suction fan is disposed in a roof of the sump for removing air from the sump as the air, liquid and debris issue from the duct into the sump.

9. A device as claimed in claim 6 wherein means is provided for filtering and recirculating liquid extracted from the sump to supply the nozzle means.

10. A device as claimed in claim 1 and having wheels for movement along the surface to be treated.

* * * * *